US008087497B2

(12) United States Patent
Fargo

(10) Patent No.: US 8,087,497 B2
(45) Date of Patent: Jan. 3, 2012

(54) COMPENSATION IN AN ELEVATOR SYSTEM HAVING MULTIPLE CARS WITHIN A SINGLE HOISTWAY

(75) Inventor: Richard Fargo, Plainville, CT (US)

(73) Assignee: Otis Elevator Company, Farmington, CT (US)

( * ) Notice: Subject to any disclaimer, the term of this patent is extended or adjusted under 35 U.S.C. 154(b) by 328 days.

(21) Appl. No.: 11/718,266

(22) PCT Filed: Dec. 29, 2004

(86) PCT No.: PCT/US2004/043612

§ 371 (c)(1),
(2), (4) Date: Apr. 30, 2007

(87) PCT Pub. No.: WO2006/071222

PCT Pub. Date: Jul. 6, 2006

(65) Prior Publication Data

US 2008/0093177 A1 Apr. 24, 2008

(51) Int. Cl.
*B66B 9/00* (2006.01)
*B66B 7/06* (2006.01)
*B66B 11/08* (2006.01)

(52) U.S. Cl. ..... 187/249; 187/257; 187/266; 187/404

(58) Field of Classification Search ..... 187/249, 187/257, 266, 404, 411, 258; *B66B 7/06, B66B 9/00, 17/12, 11/08*

See application file for complete search history.

(56) References Cited

U.S. PATENT DOCUMENTS

| | | | | |
|---|---|---|---|---|
| 849,840 | A | 4/1907 | Foster | |
| 974,439 | A | 11/1910 | Schwab | |
| 1,027,628 | A | 5/1912 | Schwab | |
| 1,763,198 | A | 6/1930 | Sprague | |
| 1,805,227 | A | 5/1931 | Rugg | |
| 1,837,643 | A * | 12/1931 | Anderson | 187/249 |
| 1,896,776 | A | 2/1933 | James | |
| 1,896,777 | A | 2/1933 | James | |
| 4,269,380 | A | 5/1981 | Shima et al. | |
| 4,724,929 | A * | 2/1988 | Coleman et al. | 187/411 |
| 5,255,759 | A | 10/1993 | Kasai et al. | |

(Continued)

FOREIGN PATENT DOCUMENTS

EP 653372 A2 * 5/1995

(Continued)

OTHER PUBLICATIONS

PCT International Search Report for International application No. PCT/US04/43612 mailed Oct. 28, 2005.

(Continued)

*Primary Examiner* — Michael Mansen
*Assistant Examiner* — Stefan Kruer
(74) *Attorney, Agent, or Firm* — Carlson, Gaskey & Olds PC

(57) ABSTRACT

An elevator system (20) includes multiple elevator cars (22, 32) within a hoistway (28). A first compensation member (40) is associated with a first counterweight (24). A second compensation member (50) is associated with a second one of the elevator cars (32). Each compensation member has one end that moves with the associated elevator system component and an opposite end (44, 54) secured in a fixed position within the hoistway. In one example, a compensation member has a linear density that is approximately four times a linear density of a corresponding load bearing member.

4 Claims, 1 Drawing Sheet

U.S. PATENT DOCUMENTS

| | | | | |
|---|---|---|---|---|
| 5,663,538 | A | 9/1997 | Sakita | |
| 5,865,274 | A | 2/1999 | Kiji et al. | |
| 5,877,462 | A | 3/1999 | Chenais | |
| 6,273,217 | B1 | 8/2001 | Hikita | |
| 6,360,849 | B1 | 3/2002 | Hikita | |
| 6,364,065 | B1 | 4/2002 | Hikita | |
| 6,554,107 | B2 | 4/2003 | Yumura et al. | |
| 7,032,716 | B2 | 4/2006 | Meyle et al. | |
| 7,117,979 | B2 | 10/2006 | Angst et al. | |
| 7,178,635 | B2 | 2/2007 | Meissner et al. | |
| 2004/0055831 | A1 | 3/2004 | Huber | |
| 2005/0082121 | A1 | 4/2005 | Deplazes | |
| 2005/0087402 | A1 | 4/2005 | Haegi et al. | |
| 2005/0279584 | A1 | 12/2005 | Reuter et al. | |
| 2006/0289240 | A1 | 12/2006 | Sakita | |
| 2007/0039785 | A1 | 2/2007 | Smith et al. | |
| 2009/0120724 | A1 * | 5/2009 | Fargo et al. | 187/257 |

FOREIGN PATENT DOCUMENTS

| | | | | |
|---|---|---|---|---|
| EP | 1371596 | A1 | | 12/2003 |
| EP | 1445229 | A1 | * | 8/2004 |
| EP | 1698580 | A1 | | 9/2006 |
| JP | 6136534 | Y2 | | 10/1986 |
| JP | 04049189 | | | 2/1992 |
| JP | 4345486 | | | 12/1992 |
| JP | 4361960 | | | 12/1992 |
| JP | 5051185 | | | 3/1993 |
| JP | 5132257 | | | 5/1993 |
| JP | 6305648 | | | 11/1994 |
| JP | 8133611 | | | 5/1995 |
| JP | 7157243 | | | 6/1995 |
| JP | 7172716 | | | 7/1995 |
| JP | 07187543 | A | * | 7/1995 |
| JP | 8133630 | | | 5/1996 |
| JP | 9110316 | | | 4/1997 |
| JP | 2000351556 | | | 12/2000 |
| JP | 2000351556 | A | * | 12/2000 |
| JP | 2001226050 | | | 8/2001 |
| JP | 2001240318 | | | 9/2001 |
| JP | 2001247265 | | | 9/2001 |
| JP | 2001251188 | | | 9/2001 |
| JP | 2001335244 | | | 12/2001 |
| JP | 2002003128 | A | * | 1/2002 |
| JP | 2002220164 | | | 8/2002 |
| JP | 2002255460 | | | 9/2002 |
| JP | 2003160283 | | | 6/2003 |
| JP | 2004155519 | | | 6/2004 |
| WO | WO 9945589 | A1 | * | 9/1999 |

OTHER PUBLICATIONS

PCT Written Opinion of the International Searching Authority for International application No. PCT/US04/43612 mailed Oct. 28, 2005.

International Preliminary Report on Patentability for International Application No. PCT/US04/43612 mailed Aug. 7, 2007.

Supplementary European Search Report for Application No. EP 04 81 5639 mailed Oct. 6, 2010.

* cited by examiner

COMPENSATION IN AN ELEVATOR SYSTEM HAVING MULTIPLE CARS WITHIN A SINGLE HOISTWAY

FIELD OF THE INVENTION

This invention generally relates to elevator systems. More particularly, this invention relates to compensation within elevator systems having more than one car in a hoistway.

DESCRIPTION OF THE RELATED ART

Elevator systems are well known. Various configurations are utilized depending on the needs of a particular situation. In many high rise buildings, compensation is used to compensate for load imbalances that occur when an elevator car is in a highest possible position, for example. Typical compensation arrangements include a rope or chain suspended beneath an elevator car and a corresponding counterweight. Opposite ends of the rope or chain are secured to the car and counterweight, respectively.

While known compensation arrangements have proven useful for many elevator systems, there are difficulties presented when introducing more than one elevator car into a hoistway. When one elevator car is positioned above another in a hoistway, the typical compensation arrangement for the higher elevator car would interfere with the operation or movement of the lower car. One proposal is shown in U.S. Pat. No. 5,584,364. A drawback to such an arrangement is that it includes special vibration dampers to accommodate the compensation ropes. An alternative compensation arrangement is needed.

This invention addresses that need by providing compensation for an elevator system having multiple cars in a hoistway.

SUMMARY OF THE INVENTION

An example elevator system includes a first elevator car supported for vertical movement within a hoistway. A first counterweight is coupled with the first elevator car by a first load bearing member. A second elevator car is positioned below the first elevator car and supported for vertical movement in the same hoistway. A second counterweight is coupled with the second elevator car by a second load bearing member. The second counterweight is positioned above the first counterweight. A first compensation member is associated with the first counterweight. A second compensation member is associated with the second elevator car.

In one example, the first compensation member has a first end that moves with the first counterweight and a second end that is secured in a stationary position in the hoistway. The second compensation member has a first end that moves with the second elevator car and a second end that is secured in a stationary position in the hoistway.

In one example having a 1:1 roping ratio, the compensation members are selected to have a mass-per-unit length that is approximately four times greater than the collective mass-per-unit length of the load bearing members. In another example having a 2:1 roping ratio, the compensation members mass-per-unit length is approximately eight times that of the load bearing members.

In one example, a total mass of a compensation member is approximately twice the total mass of a corresponding load bearing member.

By using compensation members in the disclosed manner, it is possible to provide compensation within an elevator system having multiple cars within a single hoistway.

The various features and advantages of this invention will become apparent to those skilled in the art from the following detailed description of a currently preferred embodiment. The drawing that accompanies the detailed description can be briefly described as follows.

DETAILED DESCRIPTION OF THE PREFERRED EMBODIMENT

Figure 1:
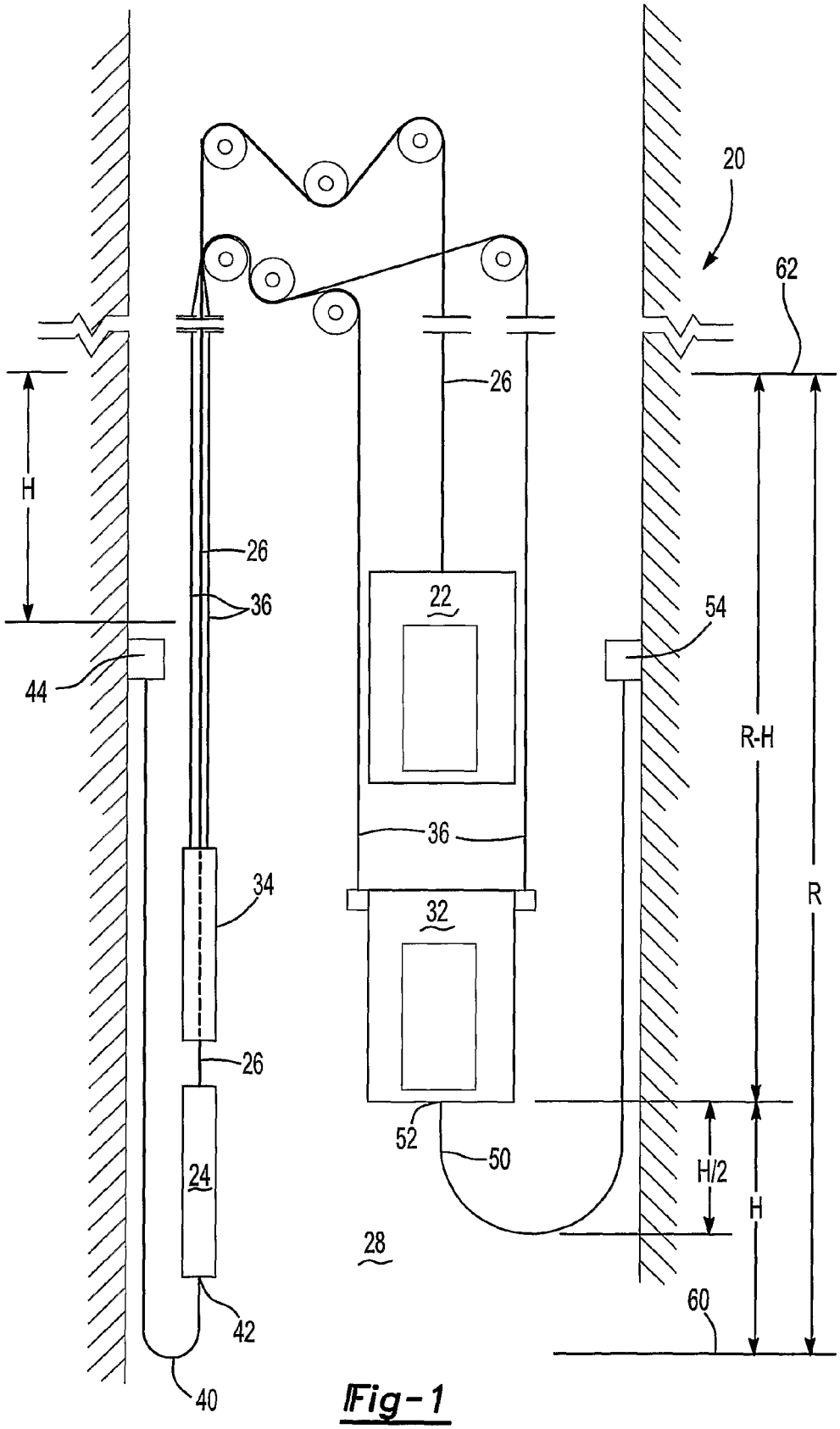
FIG. 1 schematically illustrates selected portions of an elevator system including compensation arranged according to an embodiment of this invention.

FIG. 1 schematically shows selected portions of an elevator system 20. A first elevator car 22 is coupled to a first counterweight 24 by a load bearing member 26. It is known that multiple ropes or belts placed alongside each other support the car and counterweight. The term "load bearing member" is used in this description to refer to one or more ropes or belts, for example. A machine (not illustrated) causes selected movement of the elevator car 22 and counterweight 24 within a hoistway 28 in a known manner.

The illustrated system includes a second elevator car 32 associated with a second counterweight 34 by a second load bearing member 36. The second elevator car 32 is positioned below the first elevator car 22. The first counterweight 24 is positioned below the second counterweight 34. In one example, the elevator cars share common guiderails and the counterweights share common guiderails.

Because the elevator cars are positioned one above the other, traditional compensation arrangements will not work for both elevator cars and counterweights. The illustrated example arrangement has a first compensation member 40 associated with the first counterweight 24. In this example, one end 42 of the compensation member 40 is secured to an appropriate portion of the first counterweight 24 so that the end 42 moves with the first counterweight 24. An opposite end 44 of the compensation member 40 is secured in a fixed position within the hoistway 28.

In one example, the compensation member 40 comprises a chain. In another example, the compensation member 40 comprises a rope. Known materials for malting compensation members can be used for the first compensation member 40.

A second compensation member 50 is associated with the second elevator car 32. As schematically shown, a first end 52 is secured to an appropriate portion of the second elevator car 32 for movement with the car. An opposite end 54 of the second compensation member 50 is secured in a fixed position within the hoistway 28. As the second elevator car 32, for example, travels downward, the mass of the compensation member 50 is transferred to the building (i.e., the hoistway wall) instead of being transferred to the second counterweight 34 as occurs with conventional compensation arrangements. The second compensation member 50 can be made of the same materials selected for the first compensation member 40, for example.

Securing one end of each compensation member in a fixed position within the hoistway 28 makes it possible to compensate for load conditions when the elevator system components (i.e., the cars and counterweights) are at a lowest position 60 or a highest position 62 within the hoistway 28. Securing an end of each compensation member in a fixed position within the hoistway 28 rather than suspending the compensation member between a car and corresponding counterweight avoids the interference that would otherwise occur if, for example, the first compensation member 40 were suspended between the first elevator car 22 and the first counterweight 24.

The illustrated configuration of the compensation members bears some resemblance to the manner in which traditional electrically conductive traveling cables have been installed in an elevator system. A significant difference between the illustrated compensation members and such traveling cables is that the former is far heavier than the latter. Traveling cables do not have mass sufficient to provide compensation for the load bearing members. In one example, the mass of the compensation member 50 is approximately twice the collective, total mass of the corresponding load bearing member 36. A traveling cable, on the other hand, typically has a total mass that is less than that of the load bearing member.

In one example where the load bearing members have a 1:1 roping ratio, 100% compensation, which corresponds to balancing the forces between the car and the counterweight independent of the height of the components, includes selecting a linear density or mass-per-unit length of the compensation member to be approximately four times that of the corresponding load bearing member. The collective linear density of a plurality of ropes or belts serving as the corresponding load bearing member is considered rather than that of each one individually. Referring to the illustration and considering the second compensation member 50, the second elevator car 32 and the second counterweight 34 as an example, the total tension on the counterweight side of the machine (not illustrated) can be expressed as follows:

$$Tcwt = Wcwt + H*Dsusp \quad (1)$$

Where Tcwt is the tension on the counterweight side of the machine (in kilograms), Wcwt is the weight of the counterweight (in kilograms), H is the height of the car above the lower landing (in meters) and Dsusp is the density of the load bearing member 36 (in kilograms per meter).

On the car side of the machine, the tension is equal to the weight of the car 32 plus the weight of the load bearing member 36 and the weight of the compensation member 50, which can be expressed as:

$$Tcar = Wcar + (R-H)*Dsusp + H/2*Dcomp \quad (2)$$

Where Tcar is the tension on the car side of the machine (in kilograms), Wcar is the weight of the car (in kilograms), R is the rise (in meters) and Dcomp is the density of the compensation member 50 (in kilograms per meter).

The tension difference between the car side and the counterweight side can be expressed as:

$$Tcwt - Tcar = Wcwt + H*Dsusp - (Wcar + (R-H)*Dsusp + H/2*Dcomp) \quad (3)$$

which can be expressed as:

$$Tcwt - Tcar = Wcwt - Wcar - R*Dsusp + H*(Dsusp + Dsusp - \tfrac{1}{2}Dcomp) \quad (4)$$

The tension difference will be independent of the position of the car 32 within the hoistway 28 (i.e., 100% compensation) when the (Dsusp+Dsusp−½Dcomp) term of equation (4) is equal to 0. Accordingly, ½Dcomp=2Dsusp and Dcomp=4*Dsusp.

In this example, 100% compensation is obtained by selecting the linear density of the compensating member 50 to be four times that of the load bearing member 36. Other percentages are possible by choosing other liner densities. In many instances 90% compensation is preferred. Those skilled in the art who have the benefit of this description will be able to select appropriate values to meet their particular needs.

Of course, the same analysis applies to the first elevator car 22 and the first counterweight 24 for determining a desired linear density of the first compensation member 40.

In another example including a 2:1 roping ratio, the compensation member linear density is approximately eight times the collective linear density of the corresponding load bearing member.

In the illustrated example, the compensation members 40 and 50 have a length that is approximately one-half the length of the corresponding load bearing member. Using the 100% compensation analysis described above, the illustrated example includes compensation members that have a mass that is twice the mass of the corresponding load bearing member.

The disclosed compensation technique makes it possible to provide compensation in high rise applications of an elevator system having more than one elevator car within a hoistway.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

I claim:

1. An elevator system, comprising:

a first elevator car supported for vertical movement within a hoistway;

a first counterweight;

a first load bearing assembly comprising a plurality of load bearing members coupling the first elevator car and the first counterweight;

a second elevator car positioned below the first elevator car and supported for vertical movement in the hoistway;

a second counterweight positioned above the first counterweight;

a second load bearing assembly comprising a plurality of load bearing members coupling the second elevator car and-the second counterweight;

a first compensation member associated with the first counterweight, and having a first end that moves with the first counterweight and a second end that is secured in a stationary position in the hoistway; and a second compensation member associated with the second elevator car and having a first end that moves with the second elevator car and a second end that is secured in a stationary position in the hoistway;

wherein the first load bearing assembly has an aggregate mass per unit length and the first compensation member has a mass per unit length that is approximately eight times the aggregate mass per unit length of the first load bearing assembly and the second load bearing assembly has an aggregate mass per unit length and the second compensation member has a mass per unit length that is approximately eight times the aggregate mass per unit length of the second load bearing assembly.

2. The system of claim 1, wherein the counterweights are positioned on a selected side of the elevator cars and the second end of the second compensation member is positioned on another side of the second elevator car.

3. The system of claim 1, wherein the first compensation member has a total mass that is approximately twice a total mass of the first load bearing assembly.

4. The system of claim 1, wherein the compensation member comprises at least one of a rope or a chain.

* * * * *